US007267143B2

(12) United States Patent
Simondet

(10) Patent No.: US 7,267,143 B2
(45) Date of Patent: Sep. 11, 2007

(54) DYNAMIC FILLING WITH HIGH-PRESSURE GAS MIXTURES, PARTICULARLY AN $N_2O/O_2$ MIXTURE

(75) Inventor: François Simondet, Le Chesnay (FR)

(73) Assignee: Air Liquide Sante (International), Paris (FR)

( * ) Notice: Subject to any disclaimer, the term of this patent is extended or adjusted under 35 U.S.C. 154(b) by 488 days.

(21) Appl. No.: 11/014,349

(22) Filed: Dec. 16, 2004

(65) Prior Publication Data

US 2005/0155643 A1 Jul. 21, 2005

(30) Foreign Application Priority Data

Dec. 17, 2003 (FR) ..... 03 51093

(51) Int. Cl.
*B65B 1/04* (2006.01)

(52) U.S. Cl. ..... 141/9; 141/104

(58) Field of Classification Search ..... 141/9, 141/18, 95, 104; 568/861, 864
See application file for complete search history.

(56) References Cited

U.S. PATENT DOCUMENTS 4,718,462 A 1/1988 Fix
6,169,124 B1 * 1/2001 Horn et al. ..... 521/155
2002/0020462 A1 2/2002 Wagenheim

FOREIGN PATENT DOCUMENTS

EP 1 174 178 1/2002

OTHER PUBLICATIONS

International Search Report for PCT/FR03/51093.

* cited by examiner

*Primary Examiner*—Timothy L. Maust
(74) *Attorney, Agent, or Firm*—Brandon S. Clark; Christopher J. Cronin

(57) ABSTRACT

A method of manufacturing a gas mixture of at least two components. Oxygen, nitrogen, helium, carbon dioxide, nitrous oxide, and carbon monoxide are all suitable for use as components in this method. Defined amounts of the components are dynamically mixed in order to obtain a first gas mixture at a first pressure less than 200 bar. The first gas mixture contains an intermediate amount of the second component which is less than the amount desired in the final gas mixture. A first component is then added to the first gas mixture to concomitantly dilute the second component. The addition of the first component is stopped when the pressure of the diluted gas mixture reaches a second pressure greater than both the first pressure and 170 bar, and when the diluted gas mixture contains the desired final proportion of the second component.

20 Claims, No Drawings

DYNAMIC FILLING WITH HIGH-PRESSURE GAS MIXTURES, PARTICULARLY AN $N_2O/O_2$ MIXTURE

This application claims the benefit of priority under 35 U.S.C. § 119 (a) and (b) 1 to French Application No. FR 0351093, filed Dec. 17, 2003, the entire contents of which are incorporated herein by reference.

BACKGROUND

The present invention relates to a method of dynamically filling containers with gas mixtures, particularly $O_2/N_2O$ mixtures containing an $N_2O$ proportion not less than 30% by volume, at a pressure of at least 170 bar.

At the present time, there are several methods of filling pressurized containers, such as gas bottles, with gas mixtures.

Thus, the method referred to as gravimetric filling is generally used for filling with gas mixtures based on liquefied gases, such as $N_2O$ or $CO_2$, or mixtures of air gases, such as $O_2$, $N_2$, Ar or He. However, this filling method has the drawbacks of resulting in a high level of manufacturing scrap, after analytical inspection, a low-productivity manufacturing process, since the containers must be filled one by one, a container rolling cycle that penalizes production times, and a high analytical inspection cost.

Moreover, the pressure/temperature gravimetric sequential filling method is also known. However, with this method, the mixtures produced in the various bottles from one and the same production rail often exhibit deviations in the final composition. To avoid this, it is necessary to comply with pressure stabilization and balancing times that penalize the overall productivity.

In the case of other conventional methods of filling containers with mixtures, the amounts of gas introduced are therefore controlled by measuring the pressure and the temperature of the gases. However, the determination of the gas contents is based on two measurement instruments, their measurement inaccuracies being additive. In addition, the location of the measurement points on the filling plant does not allow direct access to the physical quantities desired, i.e. the temperature and the pressure are generally measured on the filling rail by a temperature probe or a pressure sensor. However, the values thus measured are only approximations, not effective measurements of the temperature or the pressure within containers.

The method of mixing the gases dynamically partly overcomes these problems and drawbacks. This method, described for example in document EP-A-1 174 178, consists in filling the bottles with the gas mixture in its expected final composition from the start right to the end of the filling sequence. The mixture is produced upstream of the filling rail in a very small mixing chamber into which the various gaseous constituents making up the composition of the final mixture are introduced.

The amounts of each gas introduced are controlled by a mass flowmeter installed on the line for each constituent gas of the composition of the mixture to be produced. Moreover, a combination of several regulating valves is used to control the flow rate of the gases thanks to the action of an automatic regulating system. Mass metering by a mass flowmeter makes it possible to factor out any uncertainties in the measurements and any production vagaries associated with the inaccuracies as regards the amounts mentioned above.

However, filling with a dynamic mixer is accompanied, in certain cases, by expansion of the gas downstream of the mixing chamber and a lowering of the temperature of the gases below the demixing temperature, which is explained by the fact that the line downstream of the chamber is at the same pressure as the containers relative to atmospheric pressure. The gas flow is then a two-phase flow in the bottle-filling rails.

Given that the liquid and gaseous phases flow at different flow rates, the operation of filling the bottles is no longer uniform and deviations in the final contents may be observed in bottles filled from the same rail during one and the same manufacturing run. These disparities may be explained by preferential flows in the pipes of the container-filling rails.

To solve this demixing problem, document EP-A-1 174 178 has proposed to maintain the mixture above the demixing temperature by using, in order to do this, a perfectly regulated heater for heating the gases leaving the dynamic mixing chamber during the filling cycle.

Since the mixture is thus always maintained in the gaseous state, the homogeneity of the mixture is preserved and the deviations in contents are low enough to make it possible for the set of bottles to be checked by analyzing only a single bottle taken off the filling rail.

However, in practice, there is sometimes a limitation in filling containers with certain gas mixtures, in particular of the $O_2/N_2O$ type in which the $N_2O$ content is not less than 30% by volume for pressures above 170 bar.

This is because, for this type of mixture, the final pressure is limited by the pressurization of the $N_2O$ to around 170 bar. The $N_2O$ must therefore be heated in order to rise to higher pressures, which then take it into the supercritical state.

The heating temperature is also limited by the decomposition temperature of $N_2O$, the more so as certain metals of the filling device and the bottle, such as silver, platinum, cobalt, copper and nickel oxides, are catalysts for the reaction.

The dynamic filling of certain gas mixtures is therefore in general limited to a pressure of around 170 bar.

The problem to be solved is therefore how to improve the method of filling using a dynamic mixer, especially the method described by document EP-A-1 174 178, so as to be able to fill containers dynamically with gas mixtures at pressures above 170 bar, in particular medical gas mixtures of the $N_2O/O_2$ type, the $N_2O$ content of which is not less than 30% by volume.

SUMMARY

The solution of the invention is therefore a method of manufacturing a gas mixture containing at least a first component and at least a second component in desired proportions, the said first and second components being chosen from the group formed by $O_2$, $N_2$, He, $CO_2$, $N_2O$ and CO, in which:

(a) dynamic premixing in defined proportions of the said first and second components is carried out in order to obtain a gas premix at a first pressure (P1) not exceeding 200 bar and containing an intermediate content (Ti) of the said second component greater than the final content (Tf) of the said second component in the desired final composition;

(b) the pressure of the gas premix obtained in (a) is increased by introducing the first component so as to concomitantly dilute the second component with the said first component; and (c) step (b) is stopped when the gas mixture reaches the second desired pressure (P2), where P2 >P1 and P2 >170 bar, and contains a desired final content (Tf) of the second component.

DESCRIPTION OF PREFERRED EMBODIMENTS

Depending on the case, the method of the invention may include one or more of the following technical features:

- the first pressure (P1) is between 100 and 200 bar, preferably 170 bar or lower;
- the second pressure (P2) is above 200 bar, preferably above 250 bar and even more preferably 300 bar or higher;
- the first component is oxygen and the second component is nitrous oxide ($N_2O$) and, in step (a) an $O_2/N_2O$ premix is produced. The content of the first component is not less than 30%, preferably between 30 and 60%, and/or the content of the second component is not less than 35%, preferably at least 40%;
- the first component is oxygen and the second component is carbon dioxide ($CO_2$) and, in step (a), an $O_2/CO_2$ premix is produced, the content of the second component being between 1 and 10%, preferably between 3 and 7%, by volume;
- in step (a), the gas premix is introduced into one or more containers, particularly pressurized gas bottles;
- in step (a), the gas premix is produced by means of a dynamic mixer;
- in step (b), the pressure of the gas premix is progressively increased up to the second pressure (P2) and the proportion of the second component in the mixture is concomitantly decreased from the intermediate content (Ti) down to the desired final content (Tf) of the said second component in the required final mixture. To reach a precise desired final value (Tf), a mass flowmeter may be used; and
- the desired gas mixture consists of 50 vol % oxygen as first component and 50 vol % nitrous oxide ($N_2O$) as second component.

The invention also relates to a method of filling containers with gas, in which a gas mixture containing a first gaseous component and a second gaseous component is produced and introduced into several containers, the said gas mixture being produced by implementing a method of manufacture according to the invention, the gas mixture preferably consisting of oxygen and nitrous oxide ($N_2O$).

The present invention will now be described in greater detail by means of an illustrative example, namely the manufacture of an $O_2/N_2O$ gas mixture containing more than 30 vol % oxygen (50% $O_2$/50% $N_2O$ mixture) at a pressure of more than 200 bar.

The gas mixture according to the invention is produced in two main steps, namely:

- firstly the production of an $O_2/N_2O$ premix by means of a dynamic mixer so as to obtain an $O_2/N_2O$ premix at a pressure between 100 and 200 bar with an initial $N_2O$ content Ti higher than the final content Tf (for example, Ti=60% vol percent and Tf=50% vol % $N_2O$), the $O_2/N_2O$ premix being introduced into the containers, such as gas bottles, in a filling line; and
- then the premix is pressurized, that is to say its pressure progressively increased to above 200 bar, by dilution with gaseous $O_2$ until the desired final pressure, for example a pressure of 250 bar to 300 bar, or higher, is obtained.

The first step of producing the premix with a dynamic mixture allows an $O_2/N_2O$ premix to be obtained with an accuracy of ±0.5%.

Next, the dilution with a pressure rise allows a precise $O_2/N_2O$ mixture to be obtained at a high pressure, that is to say up to 250 or 300 bar or higher, preferably while monitoring the temperature/pressure pair by means of one or more temperature and pressure sensors, the accuracy resulting from the use of a mass flowmeter.

The introduction of the oxygen, during the dilution step with a pressure rise, may be controlled by mass metering using the mass flowmeter, thereby ensuring that a very precise mixture at high pressure is realized.

The mixture is generally correctly homogenized during the second preparation step; however, it may be speeded up, should it be necessary, by a container rolling cycle after filling and/or by the use of a dip tube that allows the oxygen to be introduced at the bottom of each container during the filling operation.

The advantages of the $O_2/N_2O$ mixture production method are especially: the precision and homogeneity of gaseous compositions manufactured; a final pressure of the mixture that is no longer limited by the filling method; absence of demixing at low temperatures in the case of full bottles.

This makes it possible, in most European countries and in temperate zones, to store the bottles outdoors and to transport them without any special precautions being taken, even in winter.

Furthermore, the amount stored in any one size of bottle is much greater, thereby resulting in greater autonomy for a given volume.

The method of preparation is not limited to the case of $O_2/N_2O$ mixtures. It can be-generalized to other gases or mixtures containing one or more gases, such as $CO_2$, $N_2O$, $O_2$, $N_2$, He, etc.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for manufacturing a gas mixture, said method comprising:

a) dynamically premixing at least a first and a second component to obtain a first gas mixture, wherein:

1) said first and said second components comprise at least one member selected from the group consisting of:

i) oxygen;
ii) nitrogen;
iii) helium;
iv) carbon dioxide;
v) nitrous oxide; and
vi) carbon monoxide;

2) said first gas mixture is at a first pressure less than about 200 bar; and 3) said first gas mixture comprises an intermediate amount of said second component, wherein the proportion of said intermediate amount of said second component in said first gas mixture is greater than the final desired proportion of said second component in the final gas mixture;

b) adding said first component to said first gas mixture to concomitantly dilute said second component; and c) ceasing the addition of said first component when:

1) the pressure of said diluted gas mixture reaches a second pressure which is greater than both said first pressure and about 170 bar; and 2) said diluted gas mixture contains said desired final proportion of said second component.

2. The method of claim 1, wherein said first pressure is between about 100 bar and about 200 bar.

3. The method of claim 1, wherein said first pressure is less than about 170 bar.

4. The method of claim 1, wherein said second pressure is greater than about 200 bar.

5. The method of claim 4, wherein said second pressure is greater than about 250 bar.

6. The method of claim 5, wherein said second pressure is greater than about 300 bar.

7. The method of claim 1, wherein:

a) said first component comprises oxygen; and b) said second component comprises nitrous oxide.

8. The method of claim 1, wherein:

a) the amount of said first component in said first gas mixture is greater than about 30% of the total first gas mixture volume; and b) the amount of said second component in said first gas mixture is greater than about 35% of said total first gas mixture volume.

9. The method of claim 1, wherein:

a) the amount of said first component in said first gas mixture is between about 30% and about 60% of said total first gas mixture volume b) the amount of said second component in said first gas mixture is greater than about 40% of said total first gas mixture volume.

10. The method of claim 1, wherein:

a) the amount of said first component in said final gas mixture is greater than about 30% of the total final gas mixture volume; and b) the amount of said second component in said final gas mixture is greater than about 35% of said total final gas mixture volume.

11. The method of claim 1, wherein:

a) the amount of said first component in said final gas mixture is between about 30% and about 60% of said total final gas mixture volume b) the amount of said second component in said final gas mixture is greater than about 40% of said total final gas mixture volume.

12. The method of claim 1, wherein:

a) said first component comprises oxygen;

b) said second component comprises carbon dioxide; and c) the amount of said second component in said first gas mixture is between about 1% and about 10% of the total first gas mixture volume.

13. The method of claim 12, wherein said amount of said second component in said first gas mixture is between about 3% and about 5% of said total first gas mixture volume.

14. The method of claim 1, further comprising introducing said dynamically mixed gas mixture into at least one container.

15. The method of claim 14, wherein said container comprises a pressurized gas cylinder.

16. The method of claim 1, further comprising dynamically mixing with a dynamic mixer means.

17. The method of claim 1, wherein:

a) the pressure of said first gas mixture is progressively increased up to said second pressure; and b) the proportion of said second component in said diluted mixture is concomitantly decreased from said intermediate amount to said final desired proportion of said second component in said final gas mixture.

18. The method of claim 1, wherein:

a) said first component comprises oxygen;

b) said second component comprises nitrous oxide;

c) the amount of said first component in said final gas mixture is about 50% of the final gas mixture total volume;

d) the amount of said second gas mixture is about 50% of said final gas mixture total volume.

19. A method for filling containers with a gas mixture comprising:

a) producing a final gas mixture, wherein said producing comprises:

1) dynamically premixing at least a first and a second component to obtain a first gas mixture, wherein:

i) said first and said second components comprise at least one member selected from the group consisting of:

aa) oxygen;

bb) nitrogen;

cc) helium;

dd) carbon dioxide;

ee) nitrous oxide; and ff) carbon monoxide;

ii) said first gas mixture is at a first pressure less than about 200 bar; and iii) said first gas mixture comprises an intermediate amount of said second component, wherein the proportion of said intermediate amount of said second component in said first gas mixture is greater than the final desired proportion of said second component in the final gas mixture;

2) adding said first component to said first gas mixture to concomitantly dilute said second component; and 3) ceasing the addition of said first component when:

i) the pressure of said diluted gas mixture reaches a second pressure which is greater than both said first pressure and about 170 bar; and ii) said diluted gas mixture contains said desired final proportion of said second component; and b) introducing said gas mixture into at least one container.

20. The method of claim 19, wherein said final gas mixture comprises oxygen and nitrous oxide.

* * * * *

UNITED STATES PATENT AND TRADEMARK OFFICE

CERTIFICATE OF CORRECTION

PATENT NO. : 7,267,143 B2
APPLICATION NO. : 11/014349
DATED : September 11, 2007
INVENTOR(S) : Simondet It is certified that error appears in the above-identified patent and that said Letters Patent is hereby corrected as shown below:

In Column 5, line 32, insert a --.-- after the word "volume".
In Column 5, line 46, insert a --.-- after the word "volume".

Signed and Sealed this

Twenty-seventh Day of April, 2010

David J. Kappos

David J. Kappos
*Director of the United States Patent and Trademark Office*